United States Patent [19]

Porter

[11] 4,202,445

[45] May 13, 1980

[54] SECURITY WALLET OR CONTAINER

[76] Inventor: Charles B. A. Porter, Sheristone, 4 Priory Way, Tetbury, Gloucestershire, England

[21] Appl. No.: 957,004

[22] Filed: Oct. 31, 1978

[51] Int. Cl.[2] ..... A45C 11/00; E05G 3/00; G08B 19/00

[52] U.S. Cl. ..... 206/37; 109/29; 116/2; 206/1.5

[58] Field of Search ..... 206/37, 1.5, 0.5; 116/2; 109/29

[56] References Cited

U.S. PATENT DOCUMENTS

| | | | |
|---|---|---|---|
| 2,384,826 | 9/1945 | Ferguson | 109/29 |
| 3,272,533 | 9/1966 | Allen | 206/0.5 |
| 3,568,827 | 3/1971 | Haring | 229/9 |
| 3,688,708 | 9/1972 | Meyerhoefer | 109/29 |

*Primary Examiner*—William T. Dixson, Jr.

*Attorney, Agent, or Firm*—Cushman, Darby & Cushman

[57] ABSTRACT

A security wallet or container for carrying credit cards is in the form of a rectangular hollow body containing a drawer to hold a stack of the cards. A combination lock is operative to block movement of a release pushbutton depression of which causes the drawer to spring open, when pushed back into the body the drawer automatically latching in the closed position. A defacing mechanism operates to discharge a dye or other defacing substance on to the contained cards in the event of forcible opening of the wallet or container without unlocking of the combination lock and depression of the pushbutton. The defacing substance is contained in a pressurized capsule mounted in a carrier which is spring loaded towards a blade mounted at the inner end of the drawer, the carrier normally being held back against the loading springs by latch means which are freed in the event of the drawer being forced open or a tensioned cord severed or released if the body is cut open.

10 Claims, 7 Drawing Figures

SECURITY WALLET OR CONTAINER

BACKGROUND OF THE INVENTION

This invention relates to wallets or containers, and in particular to a pocket wallet or container suitable for carrying credit cards.

Credit cards are being used in phenomenally increasing numbers, presenting a security risk of some magnitude as they are frequently lost or stolen and used illegally to obtain unauthorised credit in the form of cash, goods or services which results in a considerable and increasing financial loss every year. The object of the invention is to provide a pocket wallet or container suitable for carrying credit cards and which prevents unauthorised use thereof.

SUMMARY OF THE INVENTION

According to the invention a security wallet or container suitable for carrying credit cards is lockable and contains mechanism operative to deface the cards in the event of forcible opening of the wallet or container without following the normal unlocking procedure.

The wallet or container may have a small conventional key-operated type lock but preferably it embodies a combination lock operative to block movement of a release member operation of which opens the wallet or container. Preferably the defacing mechanism is operative to rupture a capsule which contains a defacing substance which is visible or can be detected and which is released on to the cards. The defacing substance may be a dye compatible with the plastics material from which the cards are made and which will stain indelibly on contact. In some cases a magnetic or phosphorescent powder may be used, and this may be in the form of a liquid suspension.

The defacing mechanism preferably comprises a sharp-edged and preferably serrated knife blade which cuts into the phial of defacing substance on forcible opening of the wallet or container, the substance then being sprayed in the direction of the stack of cards carried in the wallet or container. Most credit cards have embossed numerals and other identifying data which causes a natural separation between adjoining cards in a stack thereof, thereby facilitating dispersal of the defacing substance between and over the faces of the cards.

In preferred embodiments the wallet or container has a hollow body which contains a sliding drawer providing a receptacle for the cards and which is held in the closed position by a latch mechanism which is freed by the correct unlocking procedure. Preferably the drawer is spring loaded so that it springs open when unlatched, for example by means of a release pushbutton after unlocking, and is then self latching when pushed back to the closed position within the body.

Preferably the body is rectangular with the drawer slidably received at one end of the body and a combination lock at the other end, the defacing mechanism being disposed adjacent the inner end of the drawer. The lock may comprise a lateral series of rotatable wheels with peripheral numbers or letters, and a section of the body may be removable for changing the operative lock combination in which case the body section is preferably retained by screws any unauthorised removal of which triggers the defacing mechanism. Such triggering may also occur if the drawer is forced open or the body is split or cut open in order to gain access to the cards.

Other features of the invention will be apparent from the following description, drawings and claims, the scope of the invention not being limited to the drawings themselves as the drawings are only for the purpose of illustrating a way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
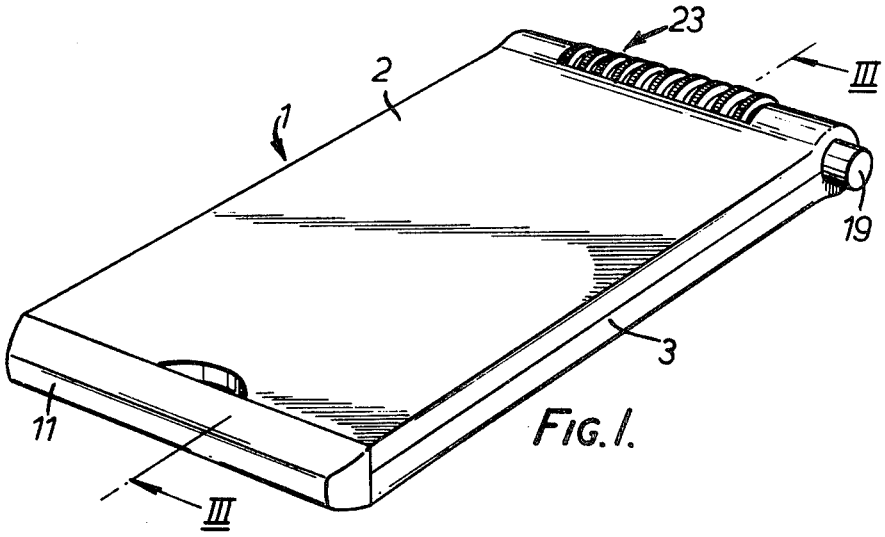
FIG. 1 is a perspective view of the wallet in normal closed condition.
Figure 2:
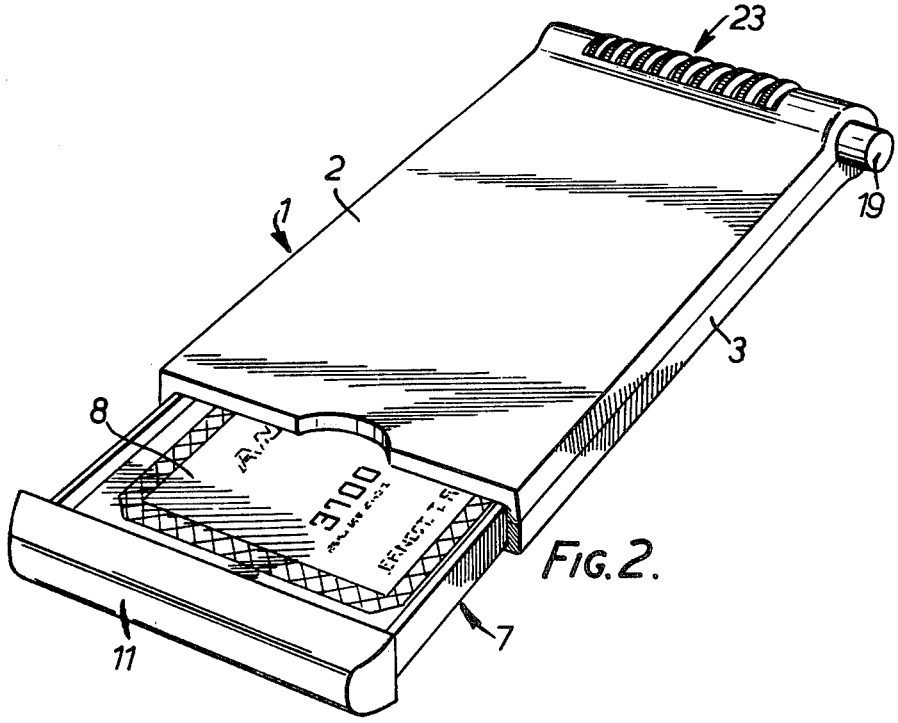
FIG. 2 is a similar view showing the wallet in the open condition, providing access to the contained stack of credit cards.
Figure 3:
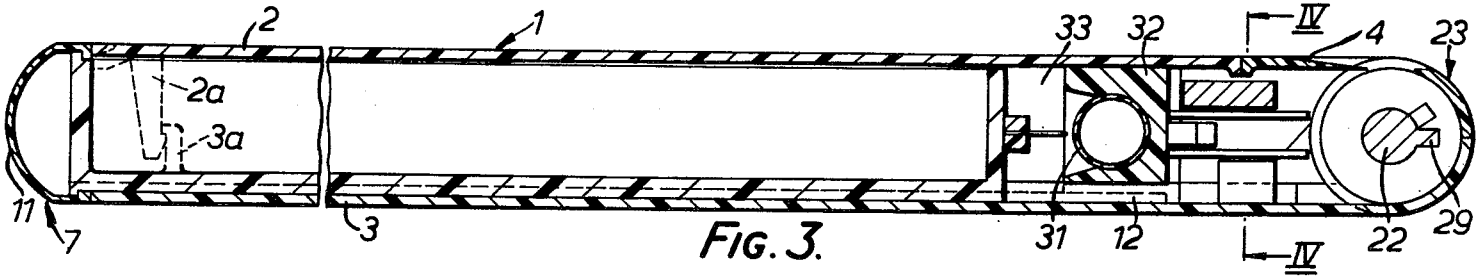
FIG. 3 is a sectional view on the line III—III in FIG. 1.
Figure 4:
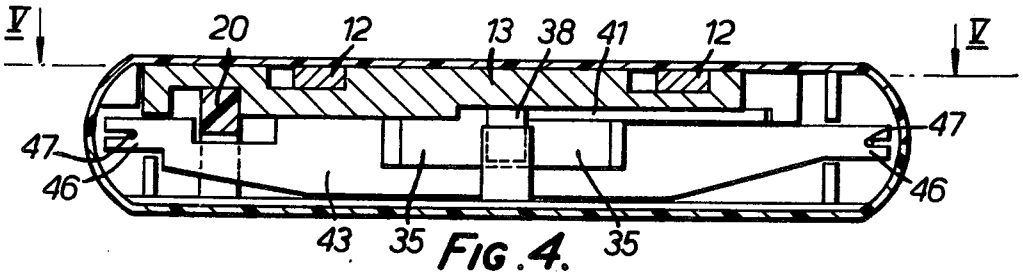
FIG. 4 is a sectional view on the line IV—IV in FIG. 3.
Figure 7:
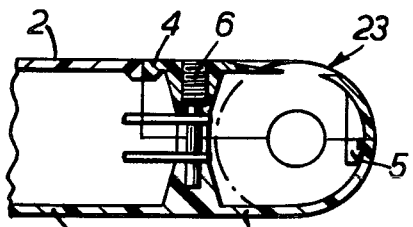
FIG. 7 is a fragmentary sectional view on the line VII—VII in FIG. 5.
Figure 6:
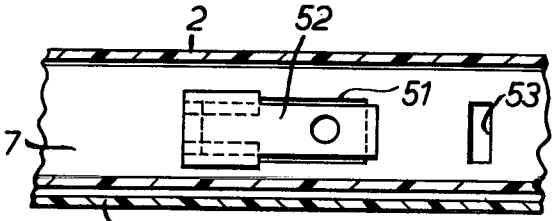
FIG. 6 is a fragmentary detail view in the direction of the arrow VI in FIG. 5.

The wallet illustrated has a body 1 providing a drawer casing comprising upper and lower halves 2 and 3 each moulded of high-impact plastics material such as a polycarbonate and secured together by locating dowels and holes as at 1*a*, or mating faces at appropriate corner points, and resiliently engaging inner lugs such as 2*a* and 3*a*. At the rear end the body is completed by a removable top section 4 with integral notched lugs 5 which clip into engagement with the back edge of the moulding 3 and which is otherwise secured by two screws 6. The body halves 2 and 3 may be additionally or alternatively secured together by an adhesive; alternatively the body halves might be of metal secured together, for example, by welding. A sliding drawer 7 which provides a receptacle for a stack of credit cards such as 8 is slidably received in the body 1 and is urged to the open position, shown in FIG. 2, by two side springs 9 which act on spring abutments 10 at the sides of the drawer 1. The drawer is a plastics moulding with a push-on front trim or cap moulding 11 and a circular base aperture 12 through which a finger can be inserted to lift the cards 8 for removal from the wallet, the normal opening movement of the drawer being about 50 mm.

The drawer 7 is securely latched by two integral latch members 12 which project at the rear end of the drawer 7 for latching engagement with a laterally-slidable latch bar 13. The latch bar 13 is urged by a latch spring 14 to the latching position defined by a stop 15 moulded integrally with the lower body half 3. Latching projections 16 on the latch bar 13 engage latching recesses 17 in the latch members 12, and the latter have inclined nose surfaces 18 which provide smooth latching engagement and automatic latching of the drawer 7 as it is pushed back into the closed position. A release pushbutton 19 projecting at one rear corner of the body 1 has a projection 20 which engages a slot 21 in the latch bar 13. The pushbutton 19 is mounted on a spindle 22 forming part of a combination lock 23, unlocking of which frees the pushbutton 19 which can then be depressed, against a return spring 28, to displace the latch bar 13 against the latch spring 14. This releases the drawer 7 which accordingly springs open.

The combination lock 23 comprises a series of rotatable wheels such as 24, in the illustrated example ten in number, with peripheral code markings, which may for example be numerals as shown or alphabetical letters, visible through corresponding apertures 25 in the removable top body section 4. Serrated rims of the wheels 24 are accessible through these apertures for locking and unlocking movement. Each wheel 24 is a plastics moulding 26, with the serrated rim and peripheral code markings, pressed on to a metal hub 27 mounted and freely rotatable on the metal spindle 22 which has projecting lugs 29 at intervals on one side only. Each wheel hub 27 has a matching slot or keyway, and when all the wheels 24 have their hubs 27 with the keyways thereof in line with the lugs 29 the spindle 22 can move axially, against the return spring 28, when the pushbutton 19 is depressed to unlatch the drawer 7. To avoid any possibility of "feeling" for the unlocked positions of the wheels 24, each hub 27 has indentations equal in number to the code markings, equiangularly spaced and of the same size as the keyway pressed on the operating or button-pressure side of the hub. These indentations are shallow, typically being 0.25 mm deep.

Each wheel hub 27 has a protruding key 30 which is engageable with any one of a ring of keyways moulded into the outer rim moulding 26, the number of these keyways being equal to the number of code markings on the wheel. Thus the mouldings 26 can be appropriately positioned on the hubs 27 to create the allotted code combination for a particular wallet. The removable body section 4 is provided to allow setting of the combination by a distributor, removal of this section enabling the combination lock 23 to be removed for individual code setting of the wheels 24.

Means to deface the credit cards 8 in the event of unauthorised opening of the wallet include a capsule 31 containing a visible dye, a liquid containing magnetic particles, or phosphorescent/fluorescent powder or a liquid suspension thereof. Defaced cards can thus be detected visually, if necessary by placing under an ultraviolet ray lamp according to the substance used, or by detection in a magnetically read cash dispenser. The capsule 31 is a thin-walled polyethylene sachet of tubular form and about 5 mm diameter, with each end sealed in a manner which creates a slight internal pressure in the encapsulated fluid. The capsule nestles within a cradle 32 disposed between the inner end of the drawer 7 and the latch bar 13. The cradle 32 is urged towards a serrated edge cutter 33, of razor blade thickness and mounted on the inner end of the drawer 7, by two heavy preloaded captive springs 34 against which the cradle 32 is held latched in position by two bellcrank latch levers 35 with latching projections 36 which engage integral latching projections 37 of the cradle.

Figure 5:
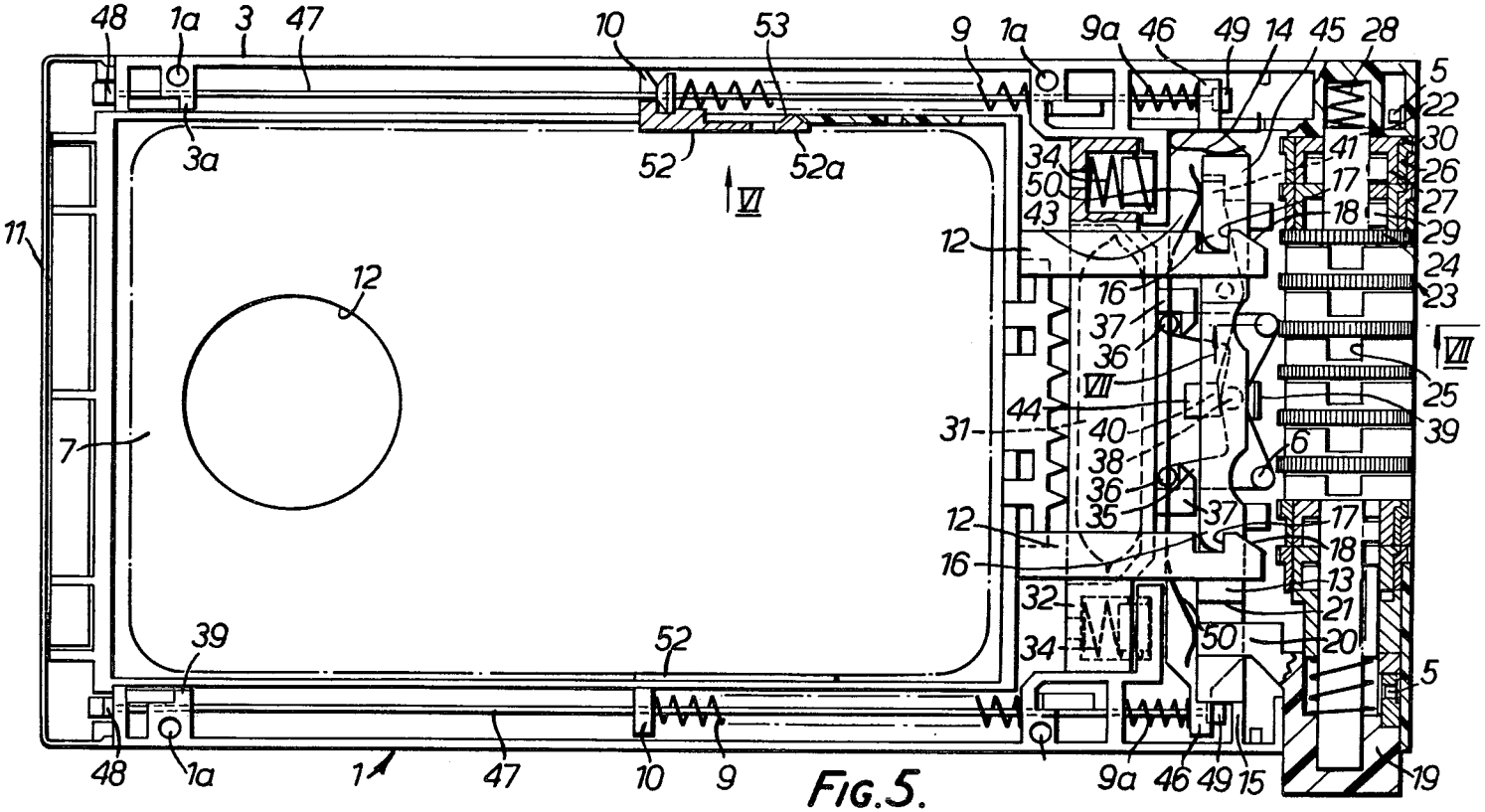
FIG. 5 is a plan view with the top half of a body of the wallet removed to show internal detail and partly sectioned.

The levers 35 are respectively pivotally mounted on the securing screws 6 for the removable body section 4 and they are pivotally interconnected at 38. In the region of the pivot 38 a latch spring 39 acts on the levers 35 urging them to the latching position shown in FIG. 5 and in which they are closely adjacent to an upward projection 40 at one end of a trigger lever 41 pivotally mounted at 42 on a crossbar 43. This projection 40 is disposed immediately behind a central upward projection 44 on the crossbar 43, and the other end of the lever 41 engages within a forwardly facing recess in an upward end projection 45 of the latch bar 13.

Projecting end sections 46 of the crossbar 43 provide the rear abutments for two springs 9*a*, and it is held against the spring forces by premoulded cords 45, of a non-creep plastics material such as a polycarbonate, which extend along either side of the drawer 7 within the body 1. These cords are moulded with end knobs 47 and 48 which respectively engage the front of the body 1 and the rear spring abutments 49, between which the cords extend through the respective abutments 10 and springs 9 and 9*a*.

A person making an unauthorised attempt to open the wallet will normally first try to prise open the latched drawer 7. In this event the drawer opening movement will result in accompanying movement of the latch bar 13 against leaf springs 50, and this pivots the trigger lever 41 which displaces the latch levers 35 against the latch spring 39. This releases the cradle 32 and thus "fires" the card defacing means. The cradle 32 is fired forwardly and the capsule 31 is forced against and ruptured by the multiple cutting edges of the cutter 33 so that the pressurised contained defacing substance is squirted on to, and between the rear edges of, the cards 8.

An alternative attempt to gain unauthorised access to the cards 8 might be made by cutting or sawing through the wallet immediately behind the end trim 11 of the drawer 7, or somewhere else along the length of the drawer. In this event at least one of the cords 47 will be cut, resulting in movement of the crossbar 43 by the corresponding short spring 9*a*. Such movement will cause the projection 44 on the crossbar 43 to displace the latch levers 35 in the unlatching direction, thereby firing the defacing means as previously described. An attempt might be made to open up the wallet by separating the two body halves 2 and 3. If this is done a moulded end 48 or 49 of the cords 47 will be released, with the same result as if one of the cords 47 were cut through.

As the screws 6 provide the pivots for the latch levers 35, an attempt to open the wallet by removing the body section 4 will free the levers 35 when the screws 6 are taken out. The levers 35 are similarly freed if the upper half of the body 1 is prised off at the back. Thus the cradle 32 is free to move forward under the force of the springs 34, the capsule 31 is ruptured and the cards 8 defaced. The drawer cap moulding 11 is a tight fit so that once fitted it is not easy to remove, and it is transparent for display of an inserted identification label. This label may carry, for example, a return address in case the wallet is lost and found.

The operative combination of the lock 23 may be set by the manufacturer, in which case the removable section 4 may be permanently fixed or integral with the body part 2. If the wallet is as illustrated and lock setting by a distributor is required, it will normally be supplied to the latter without the capsule 31 fitted. On removal of the body section 4 the lock combination can be set or changed as desired, but a special procedure is required for re-assembly involving removal of the drawer 7, which is also necessary if the distributor is to be able to replace the dye capsule 31.

To facilitate drawer removal the spring abutments 10, which limit the drawer opening movement, are detachable as will now be described. Each side of the drawer 7 has a cored moulded key-hole shaped slot 51, wider at the rear, and with the drawer open the corresponding moulded lug 52 providing the abutment 10 can be withdrawn. To do this the tail end 52*a* of the lug 52 is lifted to disengage a locating projection 53, and the lug then slid rearwardly until it can be withdrawn inwardly into the drawer through the wider end of the slot 51. The drawer 7 can now be removed and a setting tool, not illustrated, inserted in its place. This tool engages and accurately positions the latch levers 35, allowing the pivot/fixing screws 6 to be fitted to secure the casing section 4. On removal of the setting tool the drawer 7 can be inserted and the abutment lugs 52 refitted, and it is necessary for this to first partially compress and hold back the springs 9. Another tool which is not illustrated can be inserted for this purpose through elongated apertures 53 in the sides of the drawer 7.

I claim:

1. A security wallet or container suitable for carrying credit cards and comprising a hollow body, a receptacle for the cards in the form of a drawer slidably received in the body, a latch mechanism including a latch member operative to latch the drawer in the closed position, a locking mechanism operative to lock the wallet or container with the drawer in the latched position, and a defacing mechanism operative to deface the contained cards in the event of forcible opening of the wallet or container when latched without following the normal unlocking procedure, the latch member being associated with the defacing mechanism in such manner that movement of the latch member with the drawer in the event of the latter being forcibly opened while latched serves to actuate the defacing mechanism.

2. A security wallet or container according to claim 1, wherein the latch member is in the form of a latch bar movable for latch release in a longitudinal direction transverse to the direction of drawer movement.

3. A wallet or container according to claim 1, comprising a drawer-opening spring, the drawer on closing automatically being latched in the closed position and springing open on release of the latch mechanism after unlocking of the wallet or container.

4. A wallet or container according to claim 1, wherein the defacing mechanism is operative to discharge a dye or other defacing substance on to the cards and comprises a carrier for a capsule containing the defacing substance, a cutting device, and means to produce relative movement of the carrier and the cutting device whereby the latter ruptures the capsule in the event of forcible opening of the locked wallet or container.

5. A wallet or container according to claim 1, wherein at least one tension cord extends within the wallet or container, severing of this cord in the event of the wallet or container being cut open operating to trigger the defacing mechanism with resultant defacing of the cards.

6. A wallet or container according to claim 5, comprising a hollow body formed of two mouldings or pressings joined together, and a drawer slidably received in said body providing a receptacle for the cards, said cord being released, with resultant triggering of the defacing mechanism, in the event of forcible opening of the wallet or container by separation of the mouldings or pressings.

7. A wallet or container according to claim 1, wherein the locking mechanism comprises a combination lock operative to block movement of a release member operation of which opens the wallet or container.

8. A wallet or container according to claim 7, wherein a section of the wallet or container is removable to allow setting of the operative combination of the combination lock, said section being retained by screws unauthorised removal of which triggers the defacing mechanism with resultant defacement of the contained cards.

9. A security wallet or container suitable for carrying credit cards and comprising a rectangular hollow body, a drawer slidably received in the body to provide a receptacle for the cards, a locking mechanism operative to lock the wallet or container, and a defacing mechanism operative to deface the contained cards in the event of forcible opening of the wallet or container when locked without following the normal unlocking procedure, said defacing mechanism being operative to discharge a dye or other defacing substance on to the cards and comprising a carrier for a capsule containing the defacing substance, a cutting device comprising a blade mounted at the inner end of the drawer, spring means to move the carrier and capsule towards and against the blade whereby the latter ruptures the capsule, and retaining latch means which operate to hold back the carrier against the spring loading thereof and which are automatically released in the event of forcible opening of the wallet or container.

10. A wallet or container according to claim 9, wherein a latch mechanism operative to retain the drawer in the closed position comprises a latch bar normally movable for latch release in a direction transverse to the direction of movement of the carrier towards the blade and also transverse to the direction of drawer sliding movement, the arrangement being such that in the event of the drawer being forcibly opened while latched movement of the latch bar with the drawer operates to free the retaining latch means with resultant movement of the carrier towards, and rupturing of the capsule by, the cutting device.

* * * * *